US007091913B2

(12) United States Patent
Lipka et al.

(10) Patent No.: US 7,091,913 B2
(45) Date of Patent: Aug. 15, 2006

(54) ANTENNA CONTACT ASSEMBLY FOR A MOTOR VEHICLE

(75) Inventors: Günter Lipka, Deizisau (DE); Ortwin Zoller, Altdorf (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/821,252

(22) Filed: Apr. 8, 2004

(65) Prior Publication Data

US 2004/0212538 A1 Oct. 28, 2004

(30) Foreign Application Priority Data

Apr. 10, 2003 (DE) ..... 103 16 385

(51) Int. Cl.
*H01Q 1/32* (2006.01)

(52) U.S. Cl. ..... 343/713; 343/717; 343/906

(58) Field of Classification Search ..... 343/713, 343/711, 906, 712, 717; H01Q 1/32
See application file for complete search history.

(56) References Cited

U.S. PATENT DOCUMENTS 4,707,591 A 11/1987 Sprenger
6,025,806 A * 2/2000 Deininger et al. ..... 343/713
6,307,515 B1 * 10/2001 Sauer et al. ..... 343/713
6,825,812 B1 * 11/2004 Yokota et al. ..... 343/713
6,903,698 B1 * 6/2005 Silva ..... 343/713

FOREIGN PATENT DOCUMENTS

| | | |
|---|---|---|
| DE | 2 226 688 | 2/1973 |
| DE | 38 18 744 | 12/1988 |
| DE | 38 18744 | 12/1988 |
| DE | 196 05 999 | 8/1997 |
| DE | 196 27 052 | 1/1998 |
| DE | 100 19 540 | 10/2001 |
| DE | 199 83 759 | 11/2001 |
| EP | 1 367 669 | 12/2003 |

* cited by examiner

*Primary Examiner*—Hoanganh Le
(74) *Attorney, Agent, or Firm*—Andrew Wilford

(57) ABSTRACT

An antenna assembly for a motor vehicle has a housing mounted on the vehicle body and overhanging a portion of a window provided with an antenna connector structure. A carrier removably mounted on that housing has one or more contact elements which bear directly against a printed circuit board in the housing and carrying the antenna signal processing circuitry and against the antenna conductor structure on the window.

7 Claims, 6 Drawing Sheets

ANTENNA CONTACT ASSEMBLY FOR A MOTOR VEHICLE

FIELD OF THE INVENTION

Our present invention relates to an antenna contact assembly for a motor vehicle and, especially, to an electrical connection between a signal processing unit and an antenna structure which can be provided on or in a part of a motor vehicle, especially a motor vehicle window. More particularly the invention relates to a contact adapter between the signal processing circuitry for a motor vehicle antenna and the antenna conductors themselves.

BACKGROUND OF THE INVENTION

From DE 196 05 999 A1 a contact arrangement between a flat antenna conductor structure embedded in or printed on a window of a vehicle, usually the windshield or rear window, and the signal processing structure, for example, an antenna amplifier, is known. In this system, below a part of the vehicle body, for example, the roof of the vehicle, electrical circuitry in a housing can be mounted. That circuitry can be or can include an antenna amplifier and the housing containing it is attached to the vehicle body by appropriate fastening means.

The housing for the circuitry, in this construction, has a support (outrigger arm) at an end of which a contact arrangement is provided. This contact arrangement is connected by conductors in the arm or rigid carrier with the signal processing unit within the housing.

Via the contact arrangement, contact is made with contact surfaces, for example pads, of the antenna conductor structure which can be provided on the windshield or rear window of the vehicle. The elongated carrier makes it possible for the antenna conductor structure to be connected to the signal processor unit with a certain spacing between them. Because the housing and circuit unit and the antenna conductor structures are spaced apart, the assembly requires large tolerances in manufacture to be certain that the housing can be mounted at an appropriate place and the contacts of the contact arrangement can nevertheless engage the pad of the antenna conductor structure. It is not always possible to be able to observe large tolerances in practice. Furthermore, since there is a fixed distance between the contact arrangement and the circuitry, with this embodiment various housing configurations with different lengths and geometries of the outrigger arm are required for different vehicle body constructions.

A further drawback of this construction is that the entire signal processing unit with the carrier and the contact arrangement at the end thereof must be replaced completely should it be damaged in a crash. This is an expensive procedure, especially since the signal processing unit as a rule is integrated between the outer roof member of the vehicle body and the interior ceiling structure of the vehicle and thus is difficult to access.

OBJECTS OF THE INVENTION

It is, therefore, the principal object of the present invention to provide an antenna system for a motor vehicle in which the electrical connection between the signal processing unit and the antenna conductor structure is simplified, and whereby the contact with the antenna conductor structure is so made that the contact arrangement can be easily removed and replaced, tolerances in vehicle body manufacture can be bridged and the cost of replacement in the case of damage can be reduced.

Another object of this invention is to provide an improved contact adapter for the contacting of an antenna structure of a motor vehicle whereby drawbacks of earlier systems are eliminated.

It is also an object of this invention to provide an improved antenna contact arrangement which enables electrical connection of a signal processing for an antenna with an antenna conductor system with a minimum of installation problems.

SUMMARY OF THE INVENTION

These objects and others which will become apparent hereinafter are attained, in accordance with the invention with a signal processing unit which comprises a housing and at least one printed circuit board in the housing including circuitry for processing antenna signals and generally including an antenna amplifier, and at least one contact arrangement mounted in the housing and having contacts engageable with the circuit board and with at least one conductor of an array of conductors forming the antenna. The housing may have a carrier mounted directly therein and on which contacts are provided which can bear on the one hand against the printed circuit board and on the other hand against a respective pad on the contact array forming the antenna.

The contact arrangement can comprise an upper part and a lower part which are prestressed against one another and which are displaceable toward one another. The upper part may be an electrically contacting member which is elongated and is in continuous electrical contact with the lower part so that the contacting between the printed circuit board and an antenna conductor is effected through the elongated portions of the upper and lower parts in electrical contact with one another or by a conductive strip, braid, wire or the like, the heads of the upper and lower parts being biased apart by a spring braced between them.

The upper and lower parts can each have guide arms which ride in guide rails on the carrier and have hooks at their ends to limit outward displacement of these parts. Electrical connection can also be effected by a conductive synthetic resin strip or braided wire conductor or a flat cable as desired. The coil springs can be located within the upper and lower parts and the carrier as well as the upper and lower parts can be fabricated from plastic in an injection molding operation provided, of course, the portions which are to make contact and provide electrical connection will be usually composed of metal. The upper and lower parts can be identical.

More particularly, an antenna assembly for a motor vehicle body and a member, e.g. a window, provided on the body with an antenna conductor structure can comprise:

- a housing containing an antenna signal processor unit including a printed circuit board;
- a carrier mounted on or in the housing; and
- a contact element on the carrier engaging the printed circuit board and adapted to contact a conductive portion of the structure upon mounting of the housing on the body.

With the system of the invention, the signal processing unit which is mountable on or in the vehicle body, has a housing with a printed circuit board carrying the circuitry for that unit and at least one contacting element which can bear upon a conductor of the printed circuit board and upon a conductive portion of that structure with this contact element, which can be spring loaded in both directions, any tolerances between the printed circuit board in the housing and the contact pad or surface of the antenna conductor structure can be bridged.

In the construction of the contact element it is important that the latter enable sufficient movement within the element to bridge the maximum possible tolerances and yet have sufficient pressing force to generate satisfactory electrical contact engagement and transfer of signals between the contact element and the printed circuit board on the one hand and the contact pad of the conductor structure on the other.

It is also important that the carrier within the housing for the contact element be such that it permits replacement of the carrier and the contact element when, for example, in the case of a crash, the window must be replaced, without the need for replacing the signal processing unit itself.

For this purpose it is highly advantageous for the carrier to be mounted on the housing from the exterior so that it is accessible from the exterior for such replacement.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
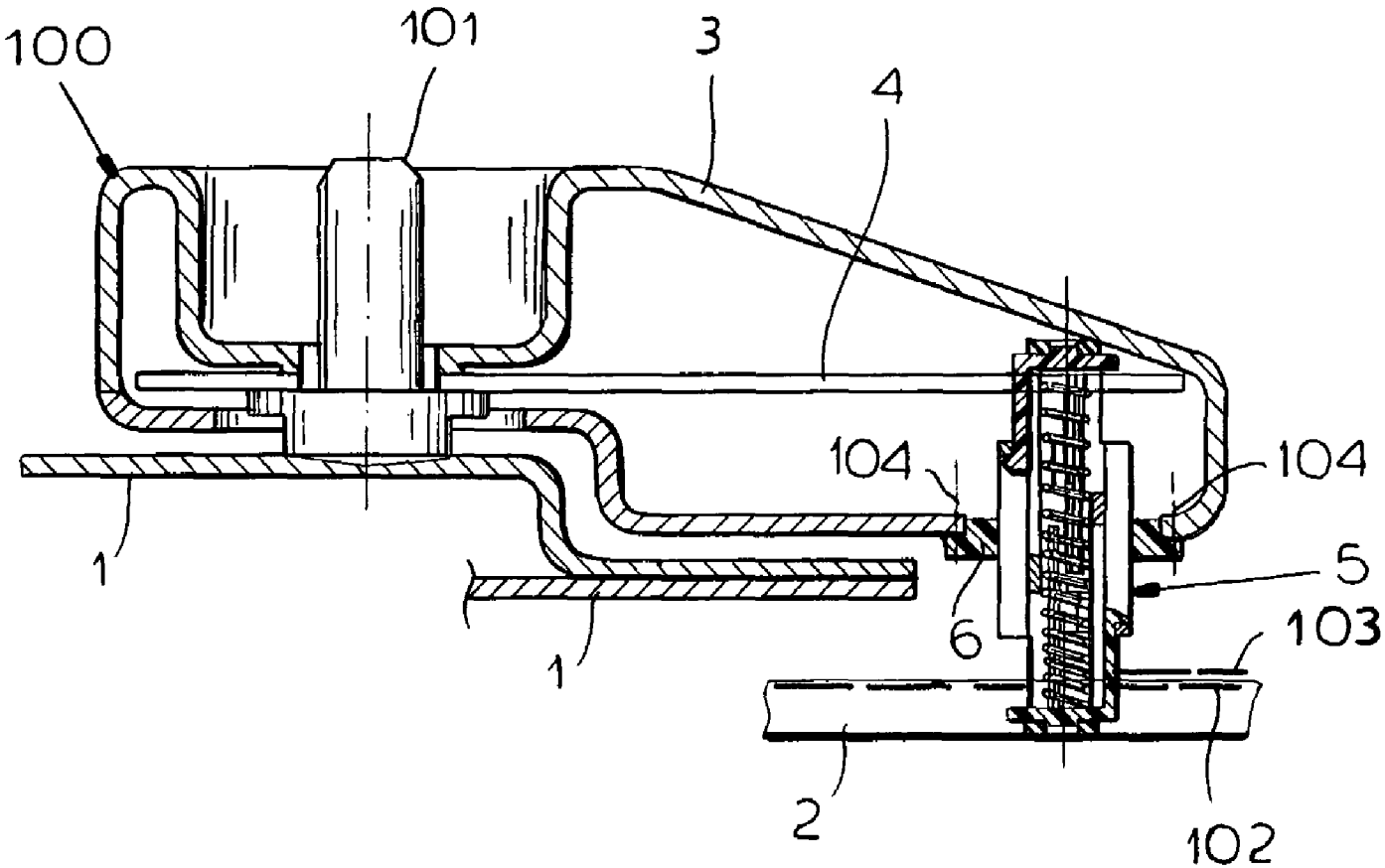
FIG. 1 is a section through a signal processing unit on a body of a vehicle, according to the invention, showing the printed circuit board and the window but without the bracing of the contact element between the printed circuit board and the contact pad.

From FIG. 1 it can be seen that a signal processing unit 100 of an antenna assembly, including an antenna amplifier, can be mounted on a part of a vehicle body 1, utilizing, for example, the anchor 101. The signal processing unit 100 is used in combination with an antenna conductor structure shown at 102 embedded in or printed on a vehicle window 2 and having contact pads 103 by means of which a connection can be made between the antenna amplifier and the antenna conductor structure. The vehicle window 2 is usually either the windshield or the rear window.

The signal processing unit 100 has a housing 3 which can be a one piece or multipiece housing and can contain a printed circuit board 4 which can carry the electronic component for signal processing including the antenna amplifier. The printed circuit board 4 also may have contact pads (copper regions) through which electrical connection can be made with the signal processing unit and the antenna conductor structure.

The contact pads on the printed circuit board 4 can correspond to contact pads of the antenna conductor structure 102 and can be aligned therewith so that contact elements 5 can each bear upon one pad of the printed circuit board 4 and one pad of the antenna conductor structure 102 and bridge the tolerance between them.

The contact elements 5 are mounted on carrier which can be affixed to the housing 3 from the exterior and can be held thereon, e.g. by removable screws, clips or the like represented diagrammatically at 104.

The contact elements 5 serve to provide electrical connection between the antenna conductor structure on the window 2 and the circuitry on the printed circuit board 4.

The following mounting steps are used: initially the housing 3 with the signal processing unit is affixed to a part of the body 1 and then the carrier 6 with the contact elements 5 can be inserted into the housing 3 so that the contact elements 5 each bear upon the printed circuit board, and the contact element 5 is partly compressed upon the mounting of the contact element on the housing 3.

Figure 2:
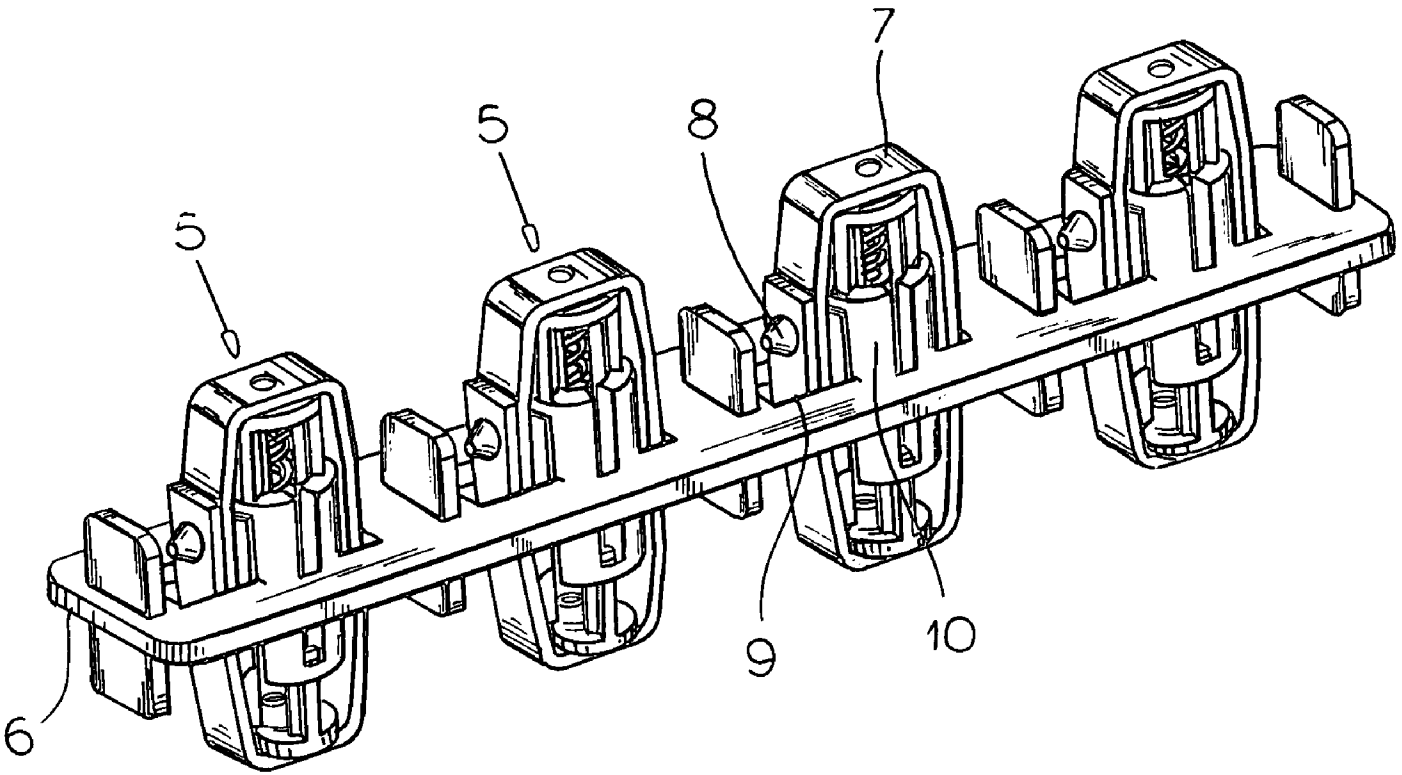
FIG. 2 is a perspective view of the contact assembly itself with a plurality of contact elements in a common carrier.

Alternatively thereto, the signal processing unit can be fabricated and the carrier 6 mounted therein, following which this unit is affixed to a part of the body 1. Then the window 2 is mounted in the body 1 of the vehicle in a conventional way so that with the mounting of the window 2 the electrical connection between the antenna conductor structure and the printed circuit board 4 is automatically made. It is important, of course, that the longitudinal extent of the contact elements 5 be such that the maximum possible spacing between the contact surfaces of the printed circuit board 4 and the antenna conductors can be bridged thereby. In a preferred mode, the actual distance will be less than the length of the contact elements so that the contact elements remain under pressure and are always braced against the members in contact therewith under prestress. This is clearly shown from FIG. 1 wherein the contact element 5 can be seen in its position prior to mounting of the window 2 to have a greater length than the distance between the printed circuit board 4 and the window 2. In FIG. 1 the contact element 5 is shown before mounting of the window. That means that the contact element 5 in FIG. 1 is shown prior to mounting of the window 2 and is compressed after such mounting and without showing its normal compression against the printed circuit board 4 following seating of the carrier 6 in the housing 3. FIG. 2 shows that the carrier can have a plurality of contact elements 5, four such elements being shown in FIG. 2.

The carrier 6 can be composed of plastic or some other nonconductive material, especially by injection molding. The electric connection with the ends of the contact element can be effected by an electrically conductive strip 7 which is placed around the prestress element shown in detail in FIG. 3 and assembled therewith by a rivet or pin 8. The carrier 6 may have recesses 9 formed therein to receive the strip and the cages 10 forming guides for the upper and lower members of the contact element may be injection molded in one piece with the carrier 6.

Figure 3:
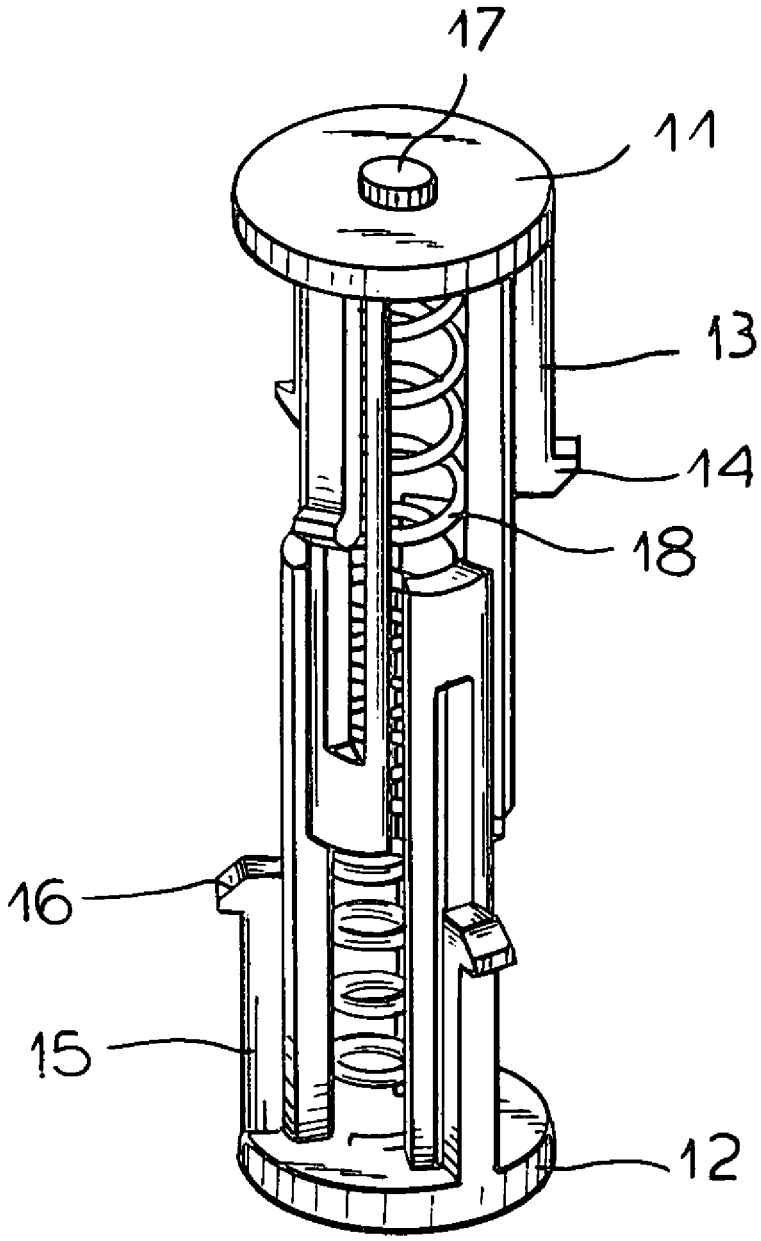
FIG. 3 is a perspective view of one of the contact elements.

As can be seem from FIG. 3, each contact element can have an upper part 11 and a lower part 12 which are braced apart by a coil spring 18 received within these parts and bearing in opposite direction on the head thereof. These parts may be identical to one another, composed of plastic or some other nonconductive material and can be fabricated especially by injection molding.

The upper part has guide arms 13 with hooks 14 of their ends while the lower part 12 also has guide arms 15 and hooks 16 at their ends.

Figure 4:
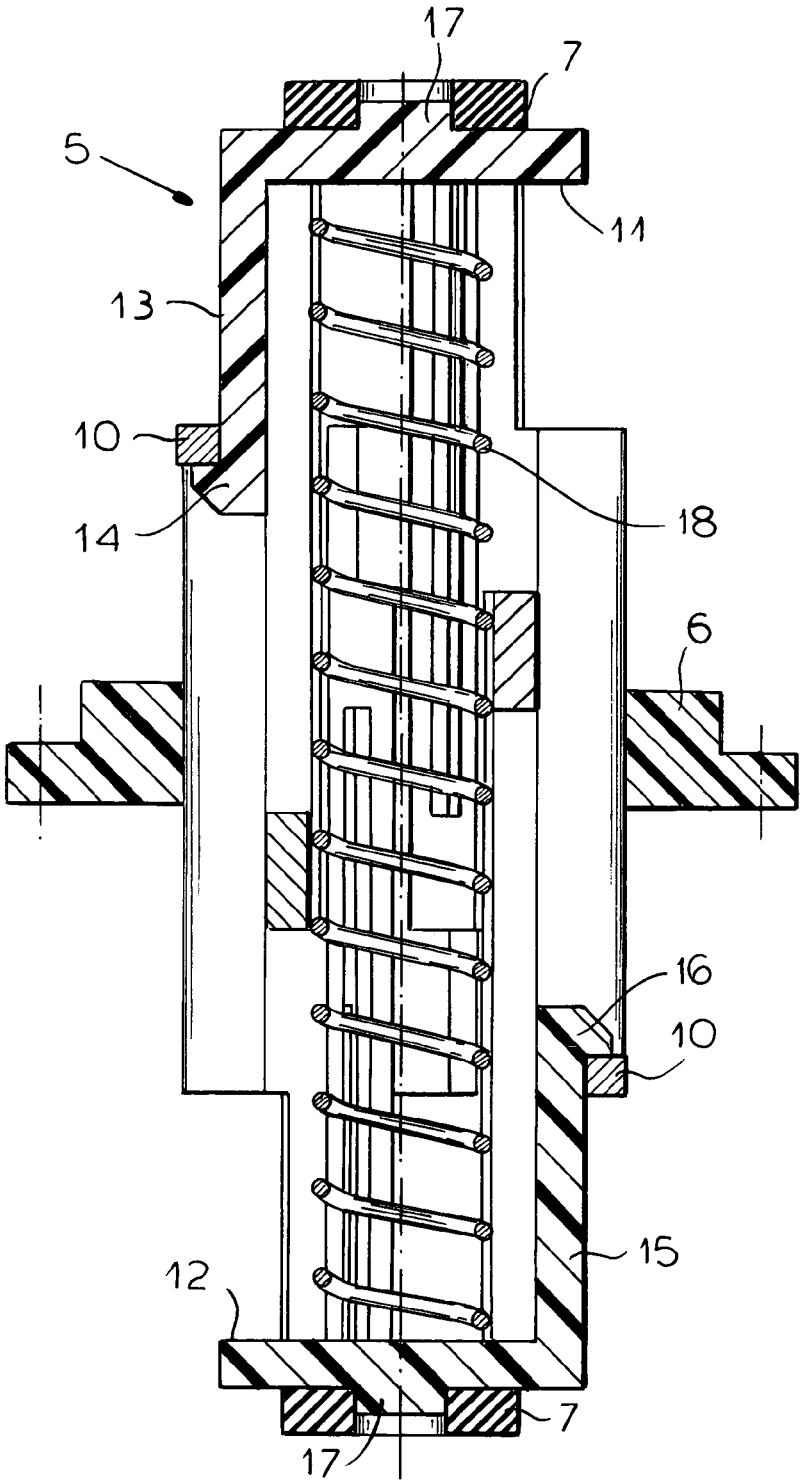
FIG. 4 is a section through the contact element of FIG. 3 but seen in place on a carrier, also shown in section.

The coil spring 18 is cast in the upper and lower parts 11 and 12 and the guide arms 13 are guided in the tracks of the cage 10 and have their hooks engageable with the ends of the cage 10 to prevent the upper and lower parts 11 and 12 from pulling out of the cage 10 (see FIG. 4) under the prestress provided by the spring 18. The parts 11 and 12 and the spring may be inserted into the cage as a unit or assembled individually within the cage and the electrically conductive strip can then be placed around the assembly.

The strip 7 can have holes into which pins 17 of the upper and lower parts 11 and 12 engage to hold the conductive strip in place. The conductive strip 7 is thicker than the height of the pin 17 so as to engage the printed circuit board and the conductor structure of the antenna. It will be apparent that the construction shown in FIGS. 3 and 4 allows the ends of the contact elements to be pressed together and thus the contact elements to bridge the tolerances between the housing 3 and the window 2. The contact elements 5, of course, are readily replaceable in the holder 6.

Figure 5:
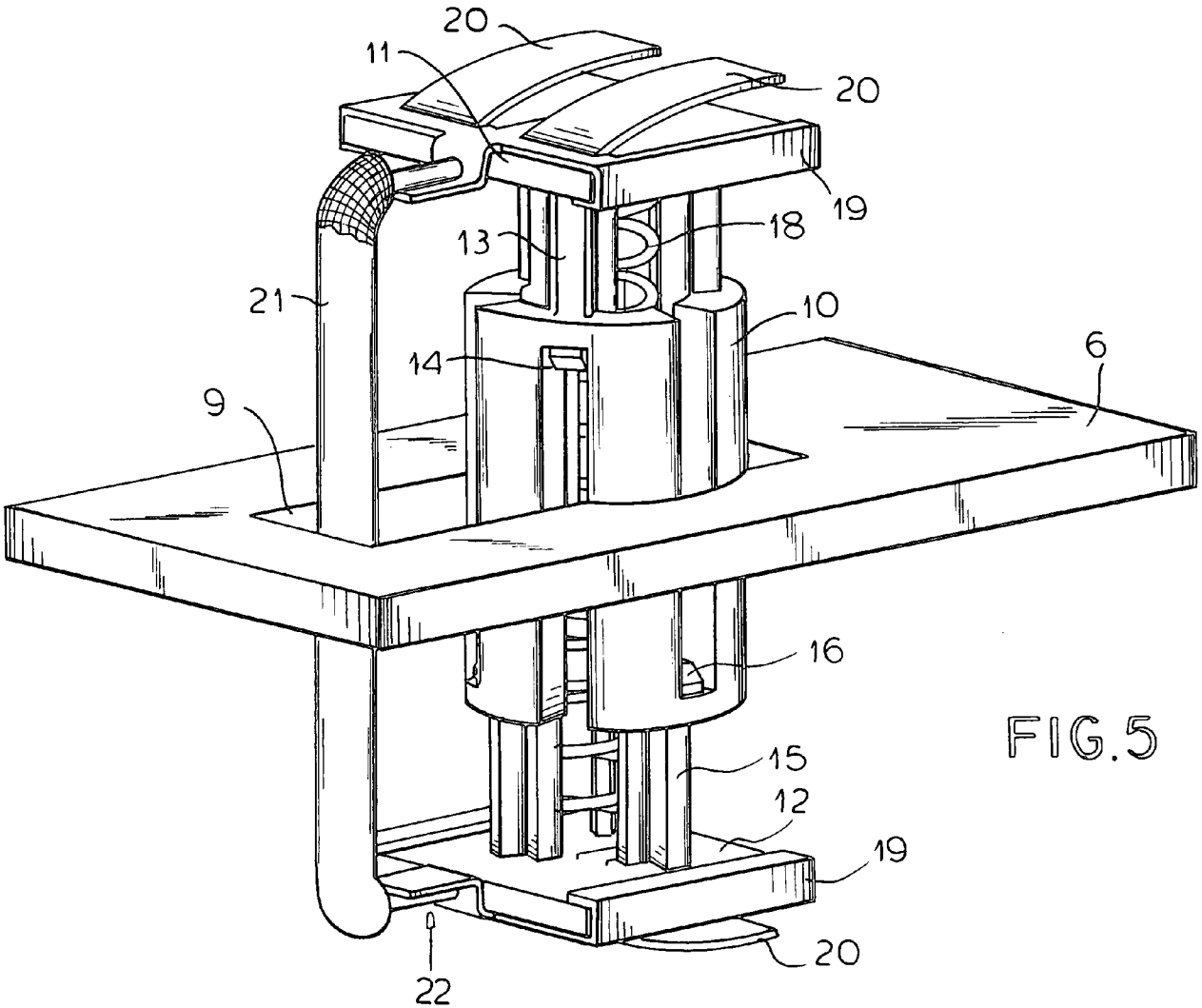
FIG. 5 is a perspective view of another embodiment of a contact element.
Figure 6:
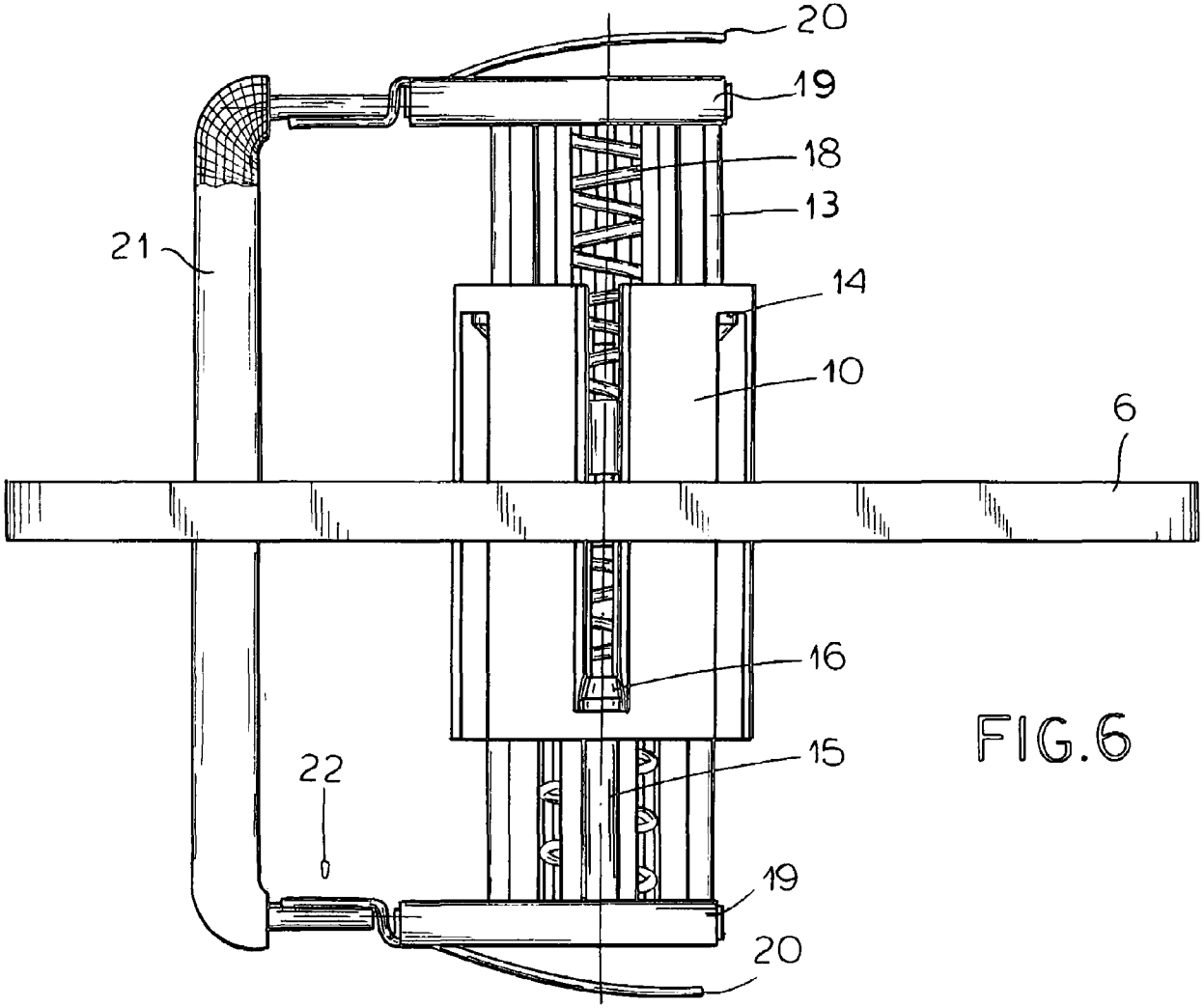
FIG. 6 is a side view of the element shown in FIG. 5.

FIGS. 5 and 6 show another embodiment of a contact element 5 and 6 and its carrier 6. In this embodiment the upper part 11 and the lower part 12 each are formed with contact blades or tongues 20 on a contact member 19 formed around the head of the upper or lower part 11, 12. The contact members 19 on the opposite ends of the contact elements are electrically connected by a braid, a conductive plastic belt or a flat cable. Reference will be made to the conductive braid 21 here.

The braid 21 has pins which are anchored at 22 to tabs of the contact members 19.

The electrical connection via a conductive strip 7, the braid 21 or similar means has the advantage that the electrical path has a fixed length regardless of the tolerances which must be bridged by the contact elements. This is especially important where the antenna is used for high frequency signals. Of course if path length is not of a concern, the upper and lower parts 11 and 12 can be conductive and can engage one another or can be connected through a conductive portion of the cage 10 to allow the electrical connection required through the contact element.

We claim:

1. An antenna assembly comprising:

a housing mountable in or on a part of a vehicle having an antenna structure;

a circuit board in said housing provided with an antenna signal processing unit;

a carrier mounted on or in said housing;

a contacting element on said carrier making electrical contact between said circuit board and said antenna structure and bridging therebetween, said contacting element having an upper part juxtaposed with said circuit board and a lower part juxtaposed with said antenna structure, a prestressing member braced between said upper and lower parts whereby said upper and lower parts are movable toward one another under a prestress of said member and said upper and lower parts do not participate in electrically connecting the circuit board with the antenna structure, and conductive means independently of said prestressing member and effecting an electrically conductive connection between said board and said antenna structure.

2. The antenna assembly defined in claim 1 wherein said conductive means provides a conductive path of constant length between said circuit board and said antenna structure.

3. The antenna assembly defined in claim 2 wherein each of said upper and lower parts has respective arms guided in guide rails, said arms having hooks at ends thereof engageable with said rails for limiting outward displacement of said upper and lower parts with respect to one another.

4. The antenna assembly defined in claim 2 wherein the continuous connection is formed by a conductive plastic strip, a braid or a flat cable.

5. The antenna assembly defined in claim 2 wherein said prestress is produced by a coil spring braced between said upper and lower parts.

6. The antenna assembly defined in claim 2 wherein said carrier and of said upper and lower parts are injection molded from synthetic resin.

7. The antenna assembly defined in claim 2 wherein said upper and lower parts are identical.

* * * * *